US006001235A

United States Patent [19]

Arken et al.

[11] Patent Number: 6,001,235

[45] Date of Patent: Dec. 14, 1999

[54] ROTARY PLATER WITH RADIALLY DISTRIBUTED PLATING SOLUTION

[75] Inventors: David M. Arken; Andrew Chiu; Joseph John Fatula, Jr.; Robert William Hitzfield; Wen-Chien David Hsiao; Yiping Hsiao, all of San Jose, Calif.

[73] Assignee: International Business Machines Corporation, Armonk, N.Y.

[21] Appl. No.: 08/881,040

[22] Filed: Jun. 23, 1997

[51] Int. Cl.[6] ..... C25D 5/00; C25D 21/06; C25D 17/00; C25B 15/00

[52] U.S. Cl. ..... 205/137; 205/98; 205/80; 204/212; 204/237; 204/224 R; 204/273; 204/DIG. 7

[58] Field of Search ..... 204/212, 237, 204/224 R, 273, DIG. 7; 205/98, 137, 80

[56] References Cited

U.S. PATENT DOCUMENTS

| | | | |
|---|---|---|---|
| 3,503,856 | 3/1970 | Blackmore | 204/273 |
| 3,652,442 | 3/1972 | Powers et al. | 204/273 |
| 3,706,651 | 12/1972 | Leland | 204/218 |
| 3,809,642 | 5/1974 | Bond et al. | 204/275 |
| 3,933,601 | 1/1976 | Ishibashi et al. | 204/25 |
| 3,963,588 | 6/1976 | Glenn . | |
| 4,032,422 | 6/1977 | Ross et al. | 204/224 |
| 4,102,756 | 7/1978 | Castellani et al. | 204/43 |
| 4,113,577 | 9/1978 | Ross et al. | 204/15 |
| 4,187,154 | 2/1980 | Dewallens | 204/5 |
| 4,271,790 | 6/1981 | Ahmed et al. | 122/26 |
| 4,304,641 | 12/1981 | Grandia et al. | 204/23 |
| 4,359,375 | 11/1982 | Smith | 204/212 |
| 4,372,825 | 2/1983 | Eidschun | 204/27 |
| 4,391,694 | 7/1983 | Runsten | 204/273 |
| 4,415,423 | 11/1983 | Brooks | 204/212 |
| 4,466,864 | 8/1984 | Bacon et al. | 204/15 |
| 4,469,566 | 9/1984 | Wray | 204/23 |
| 4,539,079 | 9/1985 | Okabayashi | 204/5 |
| 4,686,014 | 8/1987 | Pellegrino et al. | 204/15 |
| 4,720,329 | 1/1988 | Sirbola | 204/23 |
| 4,720,330 | 1/1988 | Shabrang et al. | 204/25 |
| 4,726,884 | 2/1988 | Sawa | 204/24 |
| 4,855,020 | 8/1989 | Sirbola | 204/23 |
| 4,879,007 | 11/1989 | Wong | 204/15 |
| 4,992,145 | 2/1991 | Hickey | 204/23 |
| 5,135,636 | 8/1992 | Yee et al. | 205/96 |
| 5,273,642 | 12/1993 | Crites et al. | 205/118 |
| 5,312,532 | 5/1994 | Andricacos et al. | 204/231 |
| 5,332,487 | 7/1994 | Young, Jr. et al. | 205/80 |
| 5,421,987 | 6/1995 | Tzanavaras et al. | 205/133 |
| 5,427,674 | 6/1995 | Langenskiold et al. | 205/88 |
| 5,429,733 | 7/1995 | Ishida | 204/224 |
| 5,441,629 | 8/1995 | Kosaki | 205/148 |
| 5,472,592 | 12/1995 | Lowery | 205/137 |
| 5,487,824 | 1/1996 | Griego | 205/128 |
| 5,620,581 | 4/1997 | Ang | 205/96 |

FOREIGN PATENT DOCUMENTS

| | | |
|---|---|---|
| 62-080292 | 4/1987 | Japan . |
| 1-255684 | 10/1989 | Japan . |
| 2-240222 | 9/1990 | Japan . |
| 3-044479 | 2/1991 | Japan . |
| 3-158492 | 7/1991 | Japan . |
| 4-041698 | 2/1992 | Japan . |
| 4-311591 | 11/1992 | Japan . |
| 5-255897 | 10/1993 | Japan . |
| 7-003468 | 1/1995 | Japan . |

*Primary Examiner*—Kathryn Gorgos
*Assistant Examiner*—Edna Wong
*Attorney, Agent, or Firm*—Gray Cary Ware Freidenrich

[57] ABSTRACT

A rotary plater and method of plating are provided which improve the uniformity of plating across a plating surface of a workpiece. A plating solution distribution device is located in a plating cup between an anode and a cathode in a spaced relationship therebetween and is centered about a vertical axis of the plating cup. A motor is provided for relatively rotating the cathode and the plating solution distribution device with respect to one another. The plating solution distribution device distributes the plating solution over the plating surface at a distribution rate which increases radially outwardly from the vertical axis. With this arrangement the volume of plating solution at the outer periphery of the plating surface is enriched with ions to promote plating uniformity.

20 Claims, 9 Drawing Sheets

ROTARY PLATER WITH RADIALLY DISTRIBUTED PLATING SOLUTION

BACKGROUND OF THE INVENTION

1. Field of the Invention

The present invention relates to a rotary plater with radially distributed plating solution and more particularly to a plating solution flow modifier located between an anode and a cathode in a plating cup for increasing the volume of an upward flow of the plating solution toward the cathode with an increase in distance from a center of the plating cup to an outer periphery thereof.

2. Description of the Related Art

Uniform plating thickness is necessary for manufacturing components of a magnetic head. A merged magnetoresistive (MR) head includes a write head portion adjacent a read head portion. The read and write heads are made by thin film technology employing sputter deposition, sputter etching, ion beam milling, photolithography for patterning and plating. The write head includes one or more coil layers embedded in an insulation stack sandwiched between first and second pole pieces. Channel circuitry applies a write signal current to the coil thereby producing a magnetic field in the pole pieces. The one or more coil layers and the first and second pole pieces are typically constructed on a wafer by frame plating. After constructing the first pole piece layer, a first insulation layer and a seedlayer, photoresist is spun on the wafer and then patterned by light exposure and developing to create a shaped opening in the photoresist exposing the seedlayer where copper is to be plated. The wafer is then put in a plater and copper is electroplated on the exposed seedlayer. The photoresist may also have another opening for a test site to measure the thickness of the plated copper. The wafer is then removed from the plater and the photoresist is stripped. Several insulation layers are formed on the coil followed by another seedlayer. Another photoresist layer is spun on the wafer and photopatterned by exposing the photoresist to light and developing. This leaves an opening exposing the seedlayer; the opening has the shape of the second pole piece. The wafer is again placed in the plater and Permalloy (NiFe) is electroplated on the exposed seedlayer. The wafer is then removed from the plater and the photoresist is stripped. Again, another opening may be provided in the photoresist as a test site for measuring the thickness of the plated Permalloy.

A rotary plater for plating the copper and the Permalloy includes a plating bowl for containing a first portion of a plating solution and a substantially circular plating cup located in the plating bowl for containing a second portion of the plating solution. The plating cup has top and bottom portions and a top circular rim that is centered about a vertical axis. A conduit and a pump interconnect the plating bowl to a bottom portion of the plating cup so that the plating solution can be recirculated by transfer from the plating bowl to the bottom portion of the plating cup, then upwardly in the plating cup and over the circular rim back into the plating bowl. An anode is located in the bottom portion of the plating cup and a cathode is located in the top portion of the plating cup. The cathode is capable of supporting a workpiece with a plating surface that faces downwardly so as to receive an upward flow of the plating solution. The workpiece may be a wafer substrate and the plating surface may comprise a plurality of sites for magnetic heads.

In a rotary plater the plating surface rotates relative to the plating solution. Typically the plating surface is rotated. Alternatively, the plating surface is fixed and a paddle rotates below the plating surface to swirl the plating solution around the plating surface. In both instances the plating solution is mixed to insure uniformity of the solution. Unfortunately, the plating solution moves across the plating surface at a velocity that increases with distance from the vertical axis of the plater. This causes a unit volume of the plating solution to be in contact with an outer portion of the plating surface for a shorter time than a unit volume of the plating solution is in contact with an inner portion of the plating surface. Accordingly, less ion exchange takes place between the plating solution and an outer portion of the plating surface than the inner portion of the plating surface. The result is that the plating is thicker on the inner portion of the plating surface. Excessive thickness in the write head decreases the resistance of the writing coil, potentially below a level required for reliable operation of the channel electronics. If plating is used to fabricate a second pole piece for the write head excessive thickness in this element can also change the inductance of the head and cause it to fail to meet the requirements for operation of the channel electronics.

Typical mass production techniques permit hundreds of magnetic heads to be fabricated in rows and columns on a single wafer. With non-uniform plating, the heads near the center of a wafer will be plated more thickly than heads near an outer periphery of the wafer. With the present rotary cup method, about 2% of magnetic heads are discarded at various stages of manufacturing because of thickness non-uniformities caused by presently-available plating technology. Accordingly, there is a need for improving plating uniformity in a rotary cup plater.

SUMMARY OF THE INVENTION

The present invention provides a rotary plater and method of plating which improves the uniformity of plating across a plating surface of a workpiece. A plating solution distribution device is located in the plating cup between the anode and the cathode in a spaced relationship therebetween and is centered about the vertical axis of the plating cup. The workpiece is mounted on the cathode with the plating surface of the workpiece facing downwardly. A motor is provided for relatively rotating the cathode and the plating solution distribution device with respect to one another. The plating solution distribution device distributes the plating solution over the plating surface at a distribution rate that increases with the radial distance from the central axis. In one embodiment the plating solution distribution device includes a hollow central hub centered about the vertical axis and connected to the conduit and pump for receiving the plating solution from the plating bowl. A plurality of hollow arms are connected to the central hub and radially extend therefrom, the hollow arms being in fluid communication with the central hub for receiving plating solution therefrom. Each hollow arm has a plurality of top located openings for facing the plating surface, and the openings in each arm increase in size from the hub to a terminal end of the arm so that each arm discharges an increasing volume of plating solution with an increase in radial distance from the hub. In this embodiment the cathode and plating surface are stationary while the arms are rotated. In another embodiment the conduit and pump have an outlet for discharging the plating solution into a region between the anode and the plating solution distribution device. In this embodiment the plating solution distribution device includes a substantially flat circular plate centered about the vertical axis. The plate has a plurality of apertures for transferring plating solution from the aforementioned region to the plating surface and each aperture increases in size along a radial from the vertical axis toward a periphery of the plate. In this embodiment the plating surface may be stationary while the plating solution distribution device is rotated. In both embodiments the volume of plating solution at the outer periphery of the plating surface is enriched with ions to promote plating uniformity.

An object of the present invention is to provide a rotary plater which has improved distribution of plating solution across the plating surface of a workpiece.

Another object is to provide plating solution distribution device which distributes an increased volume of plating solution to an outer portion of a plating surface as compared to an inner portion thereto.

A further object is to capture an upward flow of plating solution in a region between the anode and cathode of a rotary plater and deliver the plating solution with increasing volume toward an outer periphery of the cathode.

Yet another object is to enrich the ion content of a plating solution at an outer periphery of a plating surface in a rotary plater.

Other objects and attendant advantages of the invention will be appreciated upon reading the following description taken together with the drawings.

DESCRIPTION OF THE PREFERRED EMBODIMENTS

Figure 1:
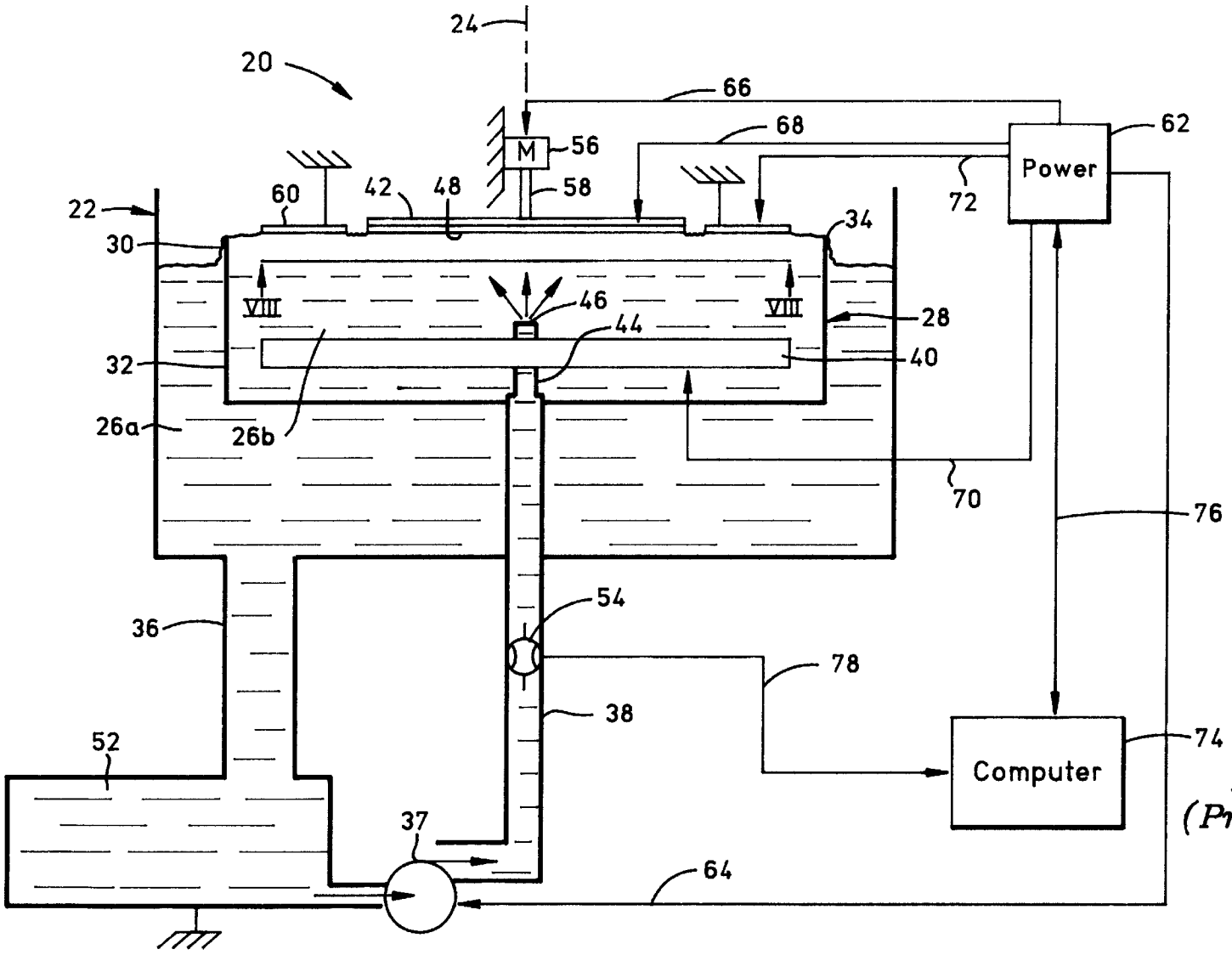
FIG. 1 (Prior Art)
FIG. 1 is a schematic elevation view of a prior art rotary plater.

FIG. 1 illustrates a schematic elevation view of a prior art rotary plater 20. The rotary plater 20 includes a plating bowl 22 which is preferably circular and is symmetrical about a vertical axis 24. The plating bowl contains a portion of a plating solution 26*a*. A substantially circular plating cup 28 is located in the plating bowl for containing another portion 26*b* of the plating solution. The plating cup has top and bottom portions 30 and 32 and a top circular rim 34 that is centered about the vertical axis 24. A first conduit 36 may extend downwardly from the plating bowl 22 to a pump 37. The pump 37 may be connected to a second conduit 38 which extends upwardly into the plating cup 28. With this arrangement, plating solution 26*a* in the plating bowl 22 is transferred by the pump 37 to the bottom portion 32 of the plating cup 28, after which the plating solution 26*b* moves upwardly in the plating cup and over the circular rim 34 back into the plating bowl 22. An anode 40 and a cathode 42 are located in the plating cup 28 and are vertically spaced from one another, the anode 40 being located in the bottom portion 32 of the cup and the cathode 42 being located in the top portion 30 of the plating cup. Each of the anode and the cathode are preferably circular plates which are horizontally positioned within the plating cup with their centers aligned with the vertical axis 24. The conduit portion 38 may have an extension 44 within the bottom portion of the plating cup 28 for mounting the anode 40 and has an outlet 46 for discharging the plating solution between the anode and the cathode.

Figure 8:
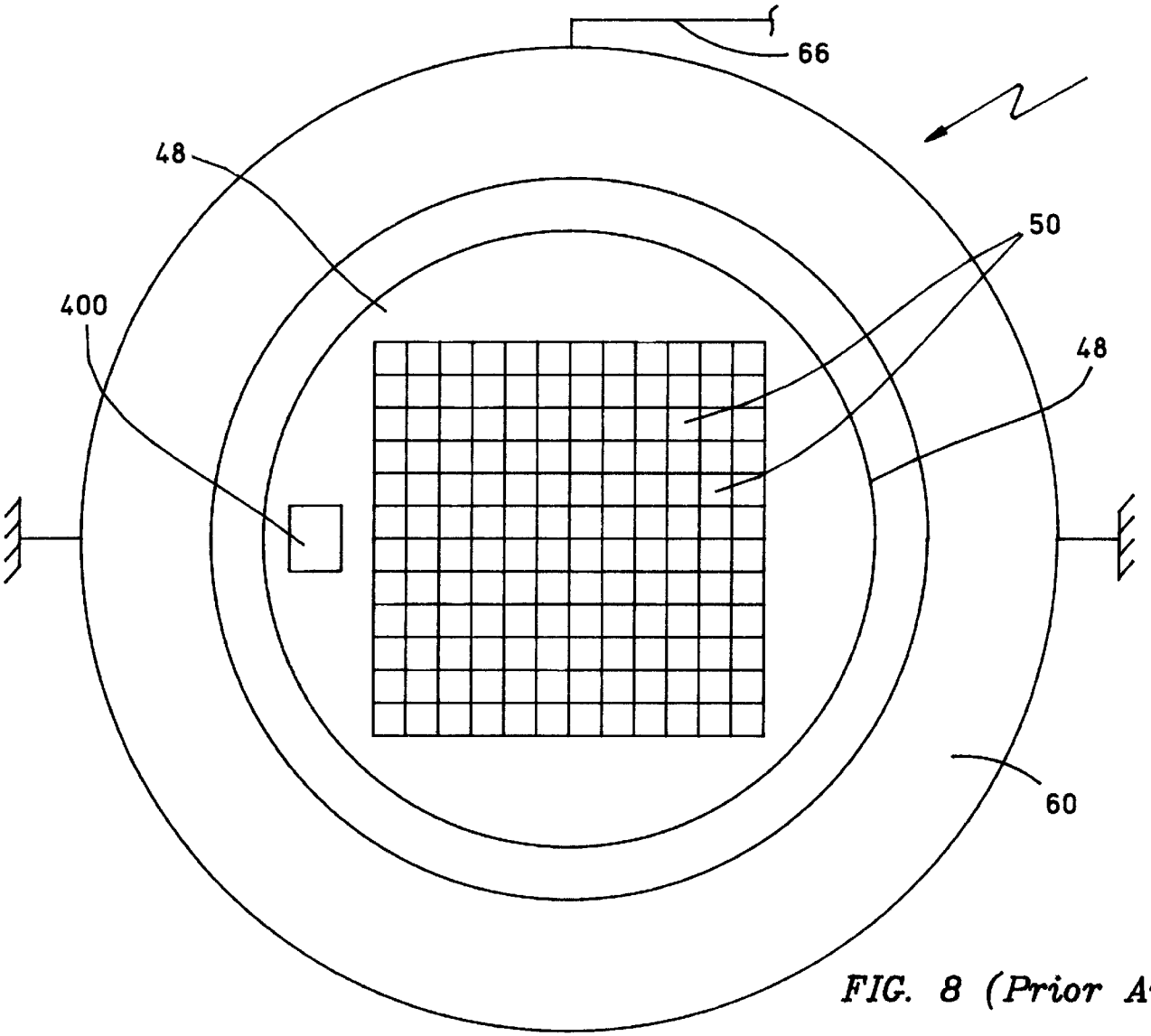
FIG. 8 (Prior Art)
FIG. 8 is a view taken along plane VIII—VIII of FIG. 1.

Mounted on a bottom side of the cathode 42 is a workpiece which may be a wafer 48. The wafer 48 may have a plurality of rows and columns of magnetic head sites 50, as shown in FIG. 8. Each head site has a plating surface where material is to be plated for forming components, such as a coil layer or second pole piece for a magnetic head. The components are formed by frame plating which comprises patterning the wafer with photoresist having openings where material is to be plated and then plating the material in the rotary plater 20. A bottom side of the wafer 48 is immersed in the plating solution 26*b* with a top side thereof preferably out of the plating solution, as shown in FIG. 1. It is important that the magnetic head components be plated uniformly across the rows and columns of head sites 50.

As shown in FIG. 1, a bath reservoir 52 may be located between the conduit 36 and the pump 37, and a flow sensor 54 may be located in the conduit 38. A motor 56 may be centrally connected to the cathode 42 by an insulated motor shaft 58. The motor 56 is fixed, as shown in FIG. 1, so that the cathode 42 is positioned in the aforementioned horizontal direction. An annular thief 60 circumscribes the wafer 48 which will be described in more detail hereinafter. With the arrangement shown in FIG. 1, the plating surfaces of the workpiece or wafer 48 receive an upward flow of the plating solution 26*b*.

A power source 62 provides regulated power to each of the pump 37, the motor 56, the cathode 42, the anode 40 and the thief 60 by electrical lines 64, 66, 68, 70 and 72 respectively. A computer 74 is connected to the power source 62 by the electrical line 76 for regulating the aforementioned powers to obtain optimized plating. As part of this scheme, the computer 74 is connected by a line 78 to the flow sensor 54 so as to monitor the volume of plating solution delivered to the plating cup 28.

Manifestly, the process performed by the rotary plater is electroplating although it has been, and will be, referred to simply as "plating".

It should be noted that the rotary plater 20 has axial symmetry about the vertical axis 24. This means that the plating bowl 22, the plating cup 28, the anode 40, the cathode 42, the wafer 48, the annular thief 60 and the extension 44 each have axial symmetry about the vertical axis 24. It should be noted further that the rotary plater 20 is a vertical plater since the plating solution 26*b* in the plating cup 28 moves upwardly in the plating cup 28 and the workpiece 48 is oriented horizontally.

A problem with the prior art plater 20 is that, upon rotation of the cathode 42, a unit volume of the plating solution 26*b* has less contact at an outer location of the rows and columns of head sites than at an inner location thereof. This causes less ion exchange with the head sites located outwardly from the vertical axis 24 as compared to the head sites located closer to the vertical axis 24. Consequently, the thickness of plating at the outwardly located head sites will be less than the thickness of the plating at the inwardly located head sites. This thickness variation can result in a 2% manufacturing loss when the thickness of some of the head components do not meet the requirements for the channel electronics. For instance, if a coil layer is plated too thick its resistance is reduced, and if a second pole piece is plated too thick its inductance is reduced. If the drop in resistance or inductance is beyond set limits, the heads cannot be used with the channel electronics designed for these components. Accordingly, it is important that the plating of the plating materialcolumns of heaws and columns of head sites 50 be made uniform.

Figure 2:
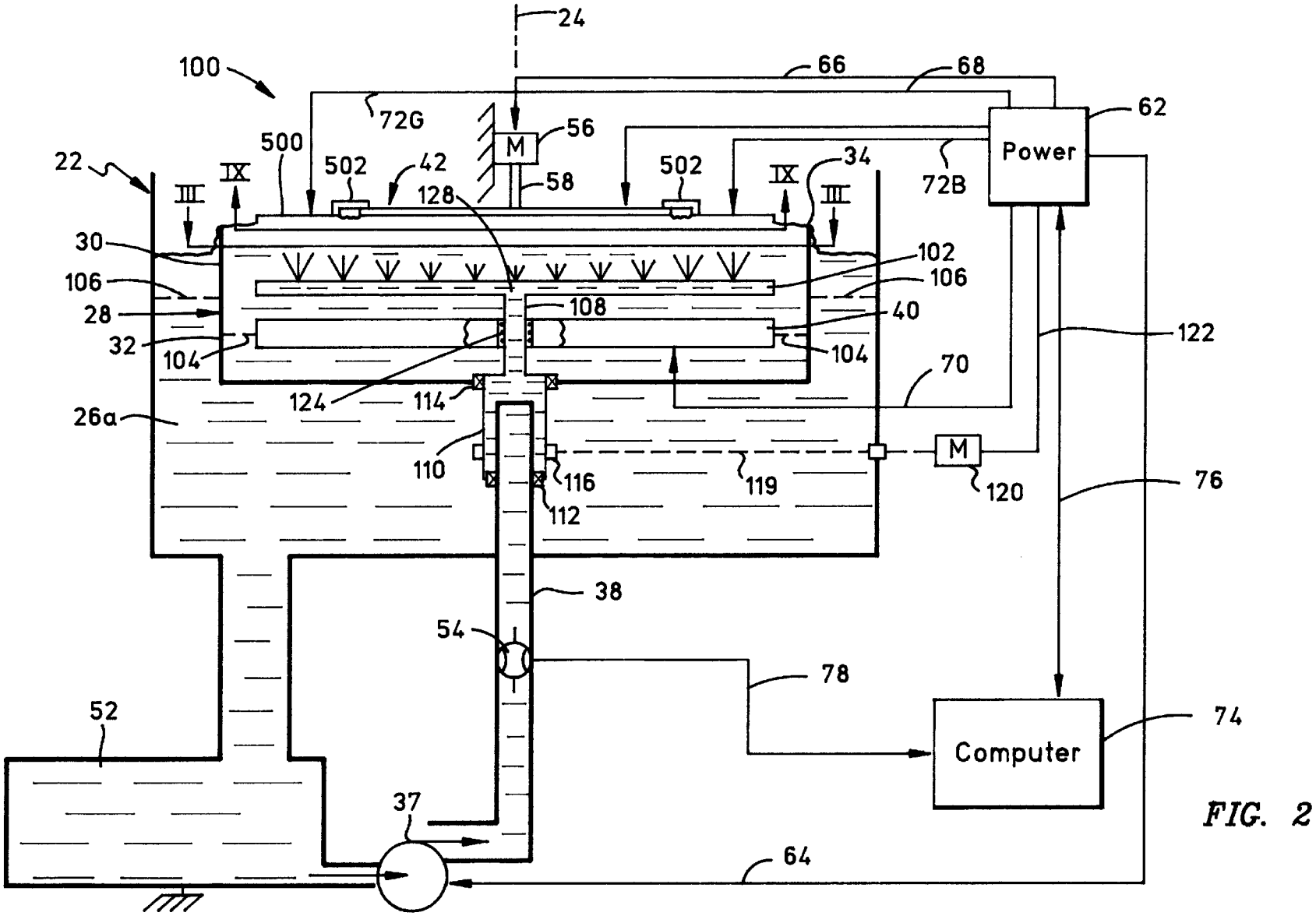
FIG. 2 is a schematic elevation view of one embodiment of the present rotary plater.

A first embodiment of the present rotary plater is shown at 100 in FIG. 2. The components of the rotary plater 100 are the same as the components in the prior art plater 20 where the reference numerals are identical. The present rotary plater 100 differs from the prior art rotary plater 20 in that a plating solution distribution device 102 is located in the plating cup between the anode 40 and the cathode 42 in a spaced relationship therebetween. The anode 40 may be fixed in place by supports 104 which are connected to an interior surface of the plating cup 32. The plating cup 32 may be fixed by brackets 106 which connect the plating cup to an inside surface of the plating bowl 22. The conduit 38 may communicate with a pipe 108 within the plating cup via an annular plenum 110. The plenum 110 is mounted to the pipe 38 by a sealed bearing 112 and is mounted to the bottom of the plating cup by a sealed bearing 114. A ring gear 116 circumscribes the plenum 110 and may be connected to a drive shaft and gear arrangement 119 from a motor 120, the motor 120 being regulated in its rotation by the power source 62 via the electrical line 122. The pipe 108 may pass through the anode 40 by means of a bearing 124 and is connected to a bottom of the plating solution distribution device 102. Accordingly, when the motor 120 is operated the plating solution distribution device 102 will rotate about the vertical axis 24 in a region between the anode 40 and the cathode 42.

Figure 3:
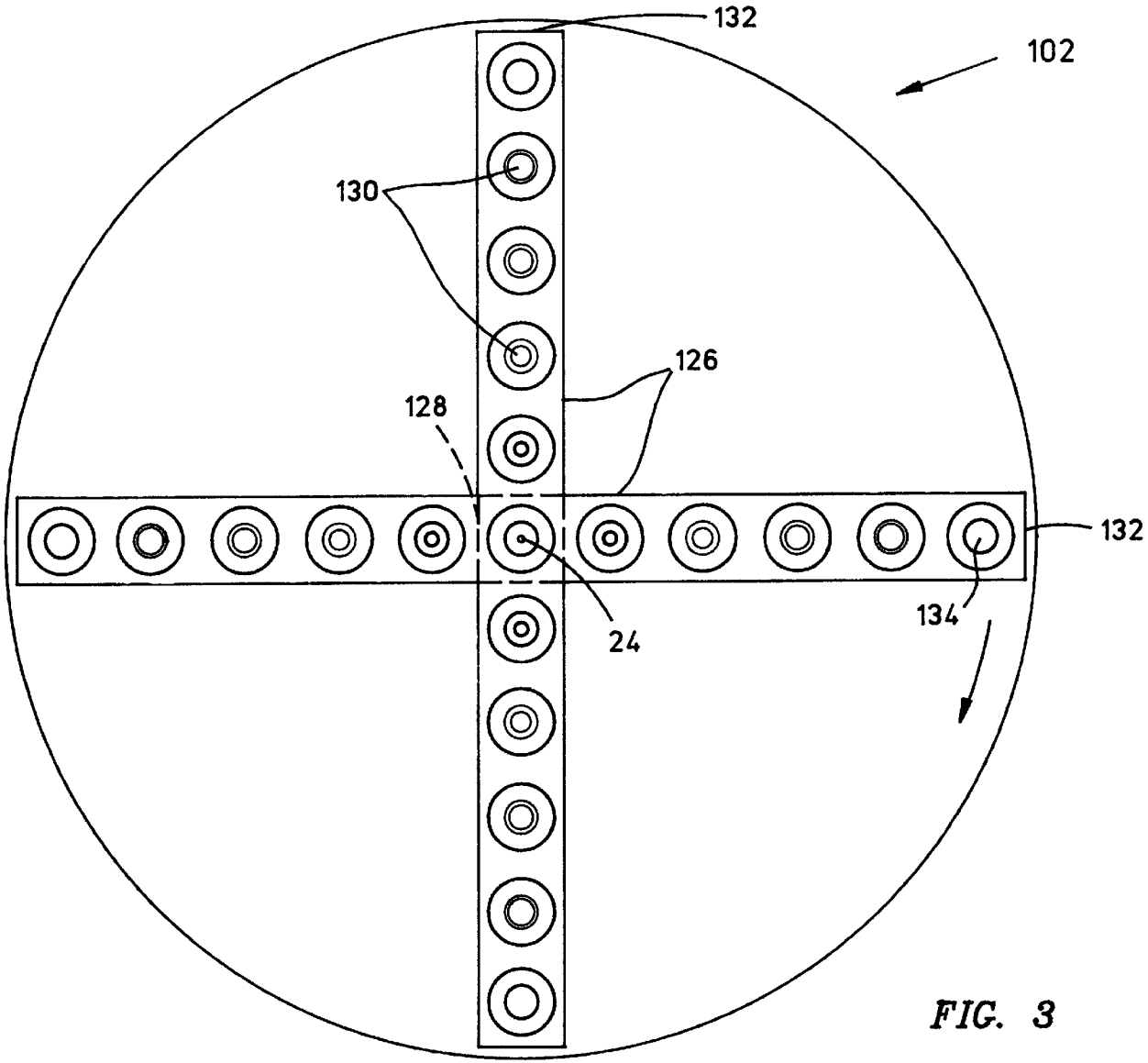
FIG. 3 is a view taken along plane III—III of FIG. 2.

As shown in FIG. 3, the plating solution distribution device 102 may include a plurality of radially extending arms 126. As shown in FIG. 2, each of these arms is hollow and is in communication with a plenum portion 128 which, in turn, is in communication with the pipe 108. Each of the arms 126 is provided with a plurality of openings 130 which increase in size from the vertical axis 24 to outer extremities 132 of the arms. The plenum 128 may also be provided with an opening at the vertical axis 24 which is smaller than the smallest opening in the arms 126. Accordingly, plating solution is discharged through the openings in the arms at an increased volume with an increase in distance from the vertical axis toward the outer extremities 132 of the arms. In a preferred embodiment the areas of the openings increase in a linear fashion from the smallest opening at 24 to the largest openings 134. When the arms 126 are rotated they will act as paddles swirling the plating solution about the plating surface of the workpiece 48. As mentioned hereinabove, this causes a unit volume of the plating solution to have less contact with outer portions of the workpiece 48, resulting in less plating. This is overcome by increasing the volume of the plating solution in these outer regions by the aforementioned increase in size of the openings 130. The increased volume will enrich the ion density of the plating solution in the outer areas so as to promote uniform plating across the plating surface of the workpiece. In the embodiment shown in FIG. 2, the cathode may be maintained stationary by the motor 56 or rotated in a direction opposite to the direction of rotation of the arms 126. When plating is performed in the presence of a stationary magnetic field (not shown) for the purpose of orienting a magnetic axis of the material plated, it may be preferable to maintain the cathode 42 stationary.

Figure 4:
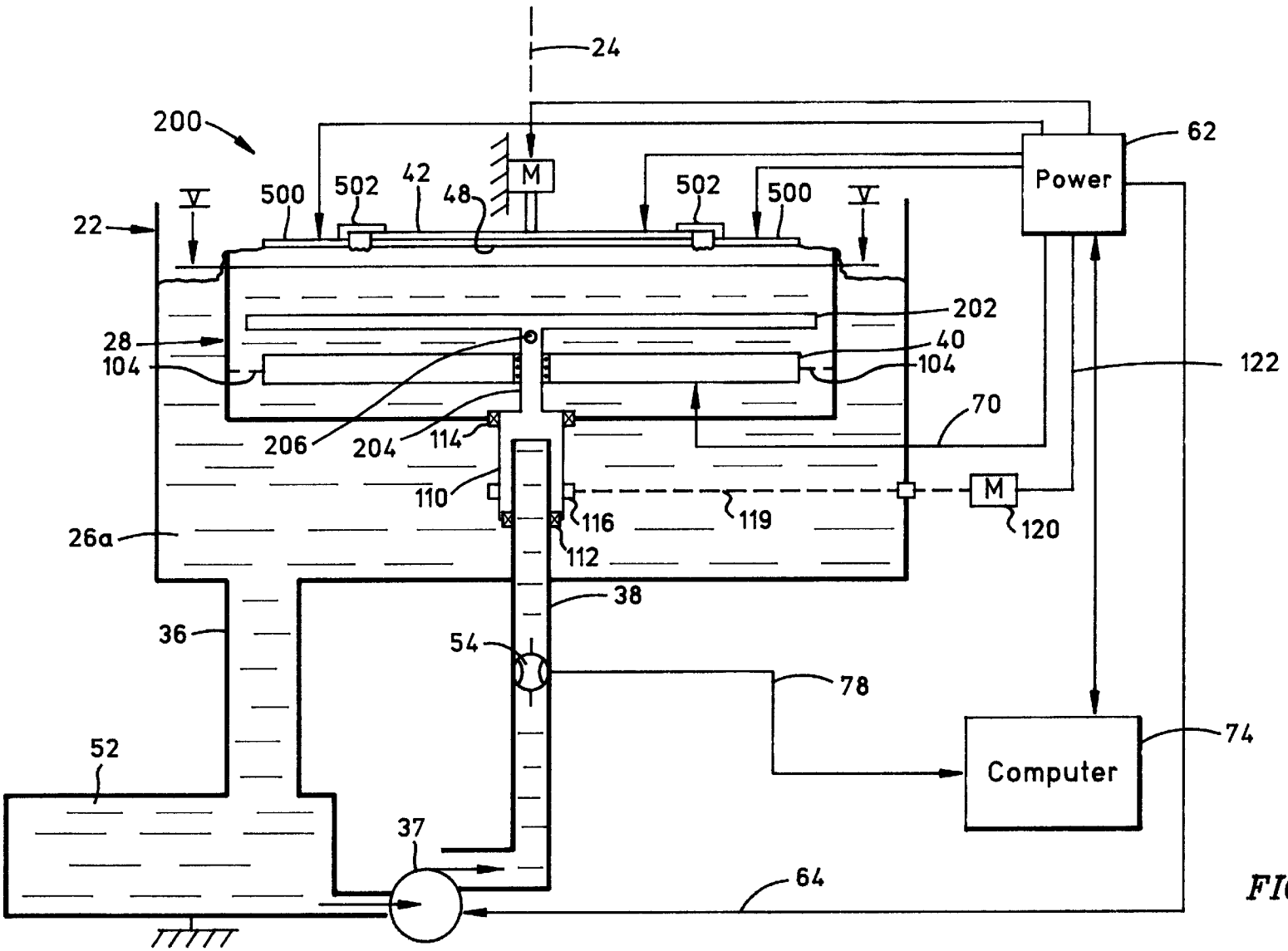
FIG. 4 is a schematic elevation view of another embodiment of the present rotary plater.
Figure 5:
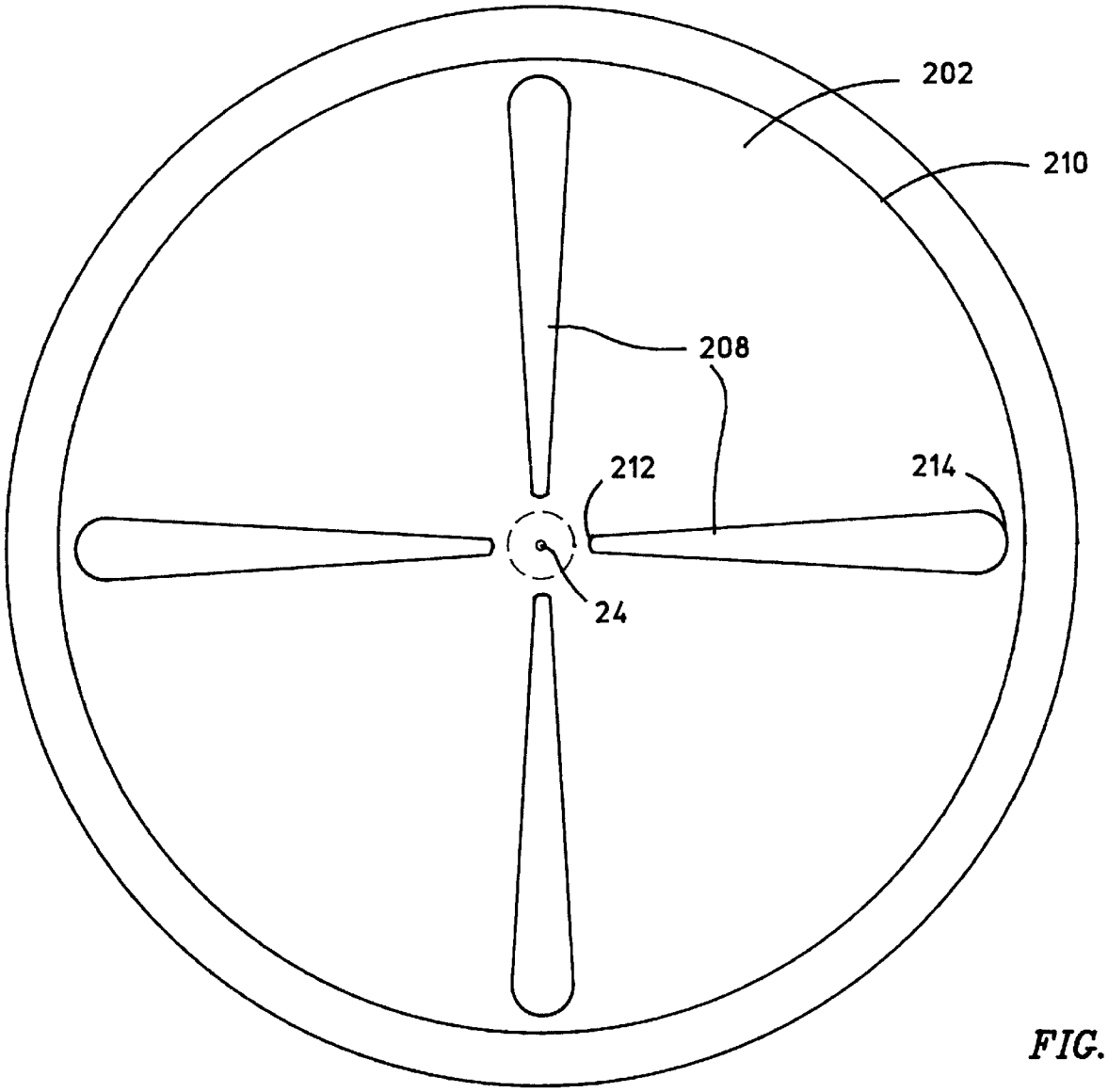
FIG. 5 is a view taken along plane V—V of FIG. 4.

Another embodiment of the rotary plater is shown at 200 in FIG. 4. The components having the same reference numerals as that shown in FIG. 1 are the same. In this embodiment, a substantially circular plate 202 is fixedly connected at its center to a pipe 204. The pipe 204 has openings 206 between the anode 40 and the plate 202 for discharging the plating solution in a region therebetween. When the motor 120 is operated, the plate 202 will rotate. As shown in FIG. 5, the plate 202 has tapered openings 208 which increase in size along a radial which extends from the vertical axis 24 toward an outer periphery 210 of the plate. It is preferable that each opening 208 increase in size linearly from its inner end 212 to its outer end 214 with the exception of rounded end portions at the outer end 214. With this arrangement, the solution discharged by the openings 206 pass through the apertures 208 causing an increased volume of plating solution to be delivered to the outer portions of the workpiece 48. In this embodiment the cathode can be maintained stationary by the motor 56 or rotated as desired.

Figure 6:
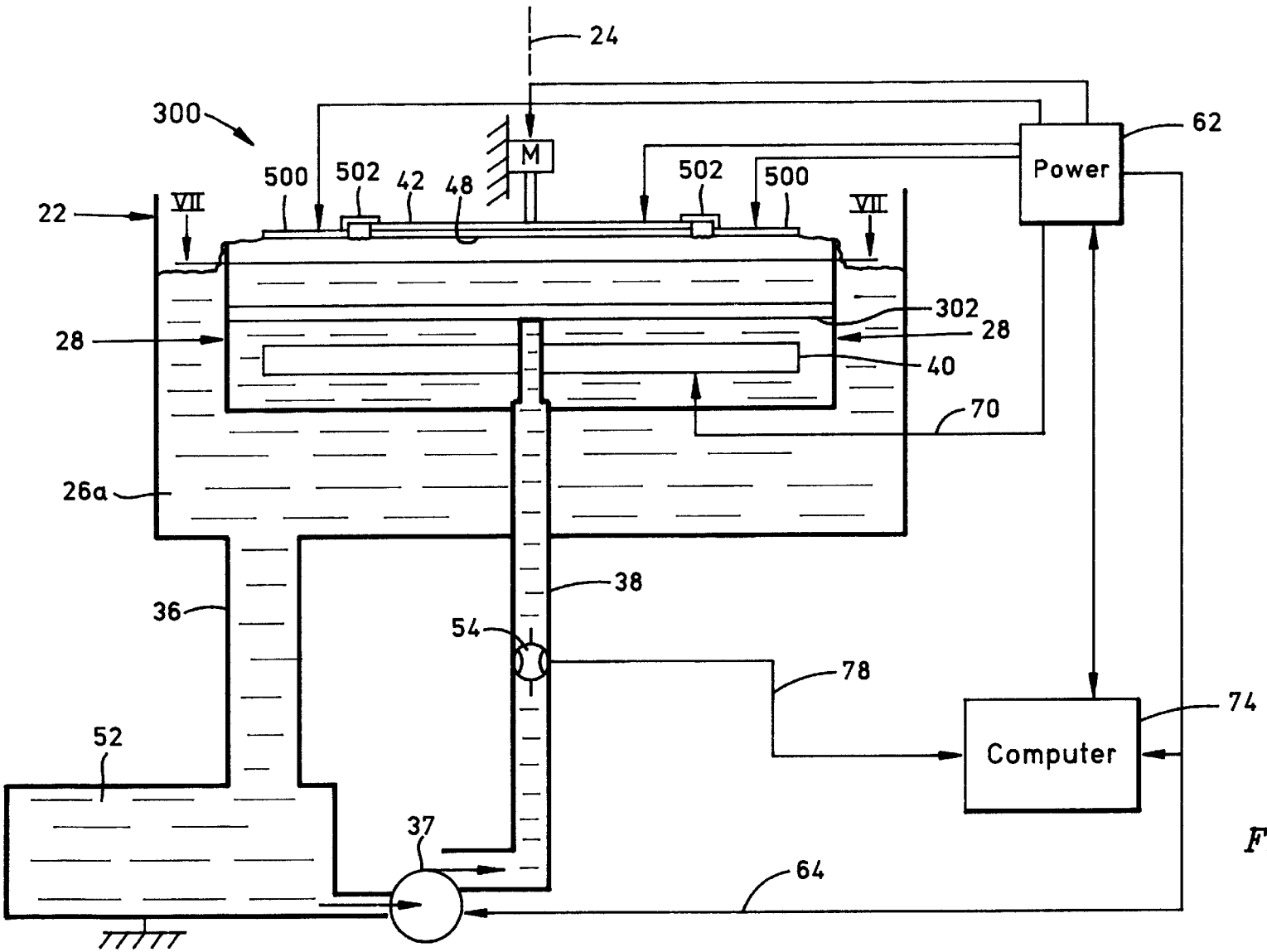
FIG. 6 is a schematic elevation view of a further embodiment of the present rotary plater.
Figure 7:
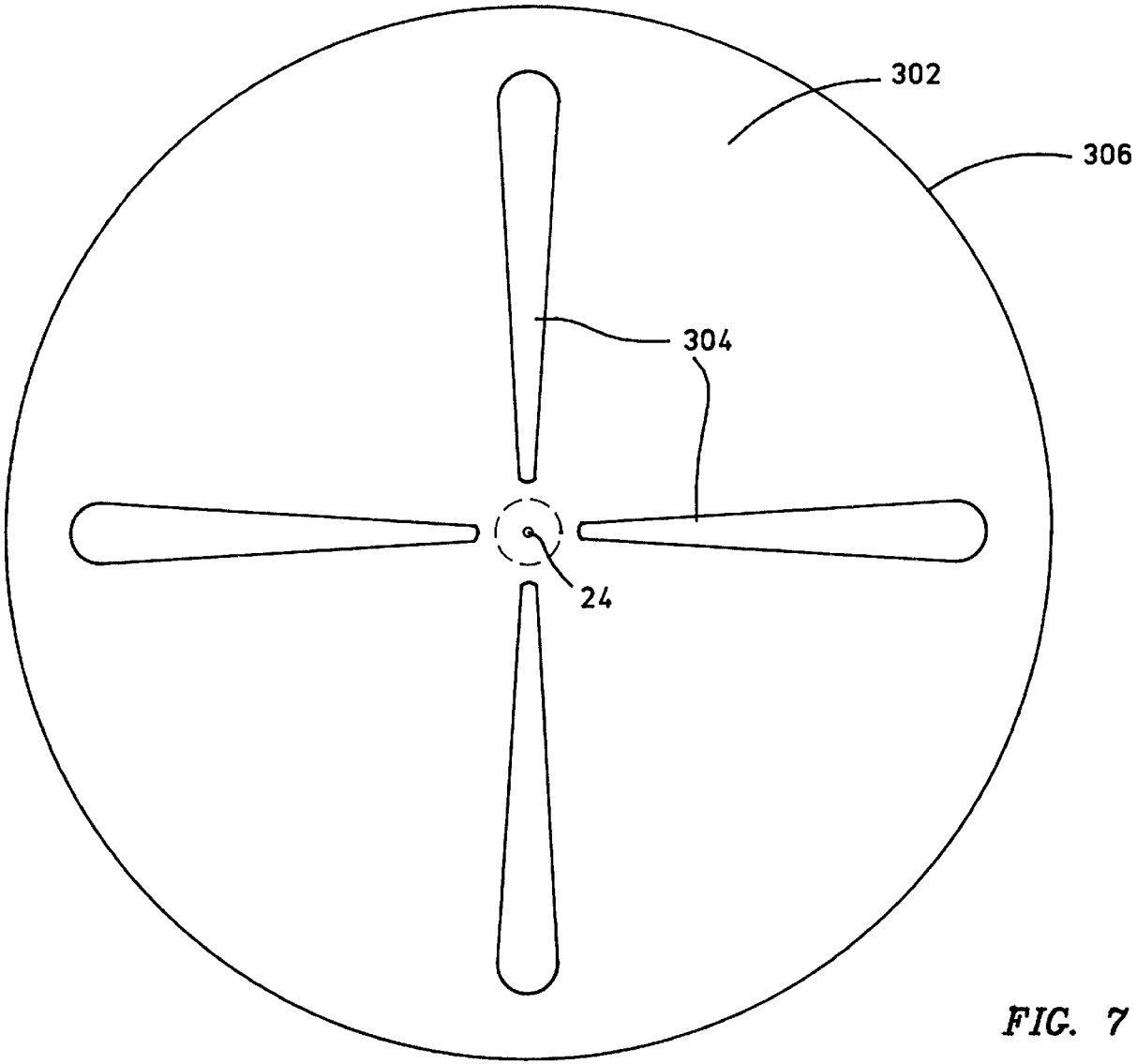
FIG. 7 is a view taken along plane VII—VII of FIG. 6.

A third embodiment of the present rotary plater is shown at 300 in FIG. 6. This embodiment has the same components as the components shown in FIG. 1 when the reference numerals are the same. The rotary plater 300 has a plate 302 which is located between the anode 40 and the cathode 42. This embodiment differs from the embodiment 200 in FIG. 4 in that the plate 302 is fixed to an inner wall of the plating cup 28 in a sealed relationship. Accordingly, the plate 302 does not rotate and the motor 120 and the plenum I 10 of FIG. 4 has been eliminated. As shown in FIG. 7, the plate 302 includes a plurality of tapered apertures 304 which increase in size from the vertical axis 24 toward an outer periphery 306 of the plate. In a like manner as the apertures 208 in FIG. 5, the apertures 304 preferably increase in size linearly to provide a linear increase in volume from the vertical axis 24 toward the outer periphery 306 with the exception of the rounded outer end portions. The plate 302 has several advantages over the plate 202 shown in FIGS. 4 and 5 in that all of the plating solution has to pass through the apertures 304 and the plate 302 does not have to be rotated. In the embodiment shown in FIG. 6, the cathode 42 is rotated by the motor 56.

FIG. 8 shows a prior art thief 60 of the prior art rotary plater 20 in FIG. 1. This thief is annular and has current supplied to it by lead 66. The thief 60 provides a potential beyond the outer extremity of the workpiece 48 to eliminate buildup of plating material on the peripheral edge of the workpiece. Because of the electrical potential on the thief 60 the buildup occurs on the thief rather than on the peripheral edge of the workpiece. As shown in FIG. 8, it is common to provide a test site 400 which is an opening in the resist for testing the thickness of plating after the plating process has been completed. It should be noted that the test area 400 acts as a little thief between the rows and columns of head sites 50 and the annular thief 60. Accordingly, the head sites closer to the test site 400 will have less thickness than head sites further therefrom. There is no way to compensate for the depletion of ions caused by the test area 400 by the prior art annular thief 60.

Figure 9:
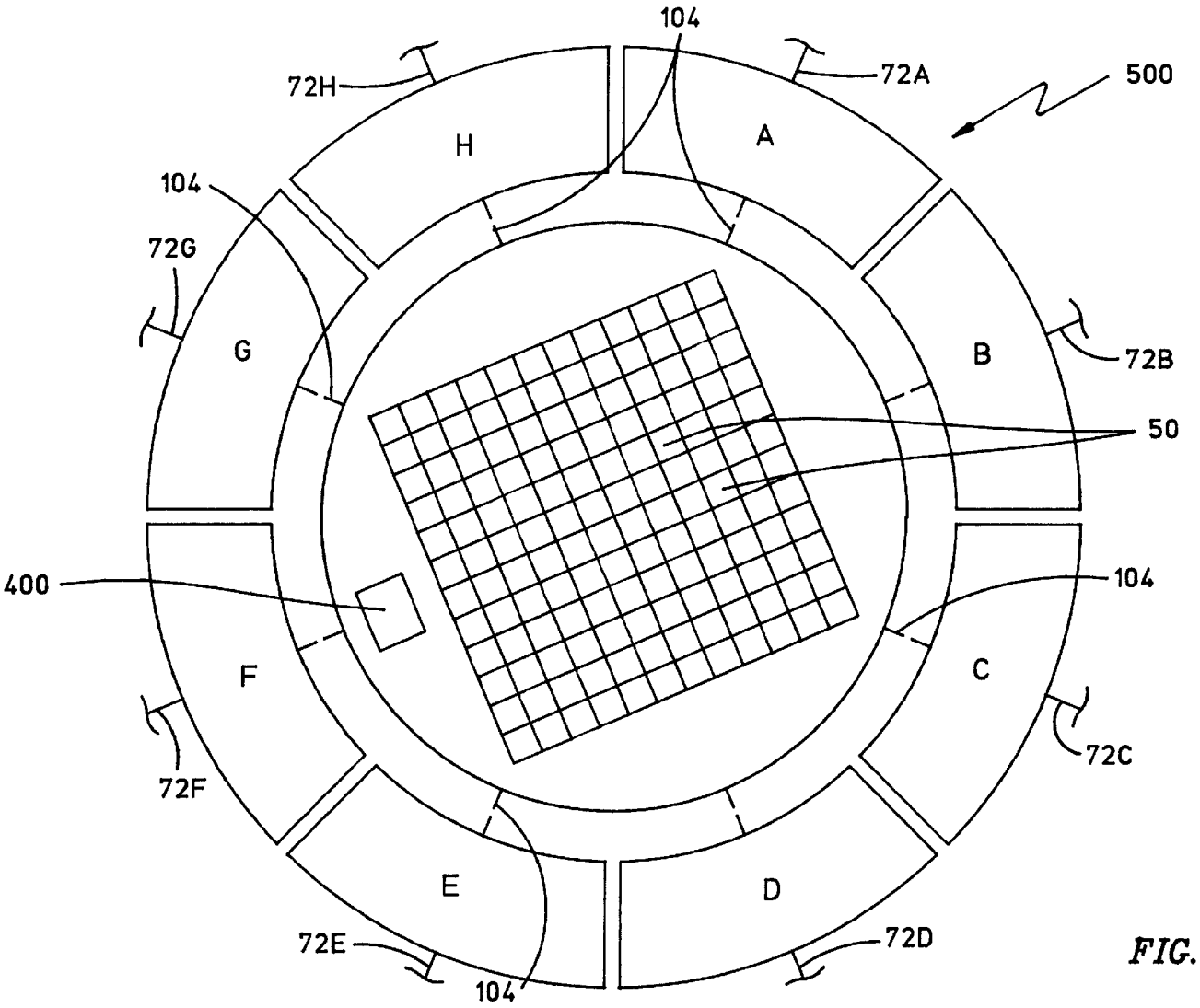
FIG. 9 is a view taken along plane IX—IX of FIG. 2.

FIG. 9 is a view of a segmented thief 500 which is also shown in FIGS. 4 and 6. The segmented thief 500 may include a plurality of segments such as segments A through H, each segment receiving regulated power from the power source 62 via leads 72A–72H. Each segment is fixedly connected to the cathode 42 by a respective bracket 502. In a preferred embodiment the rows and columns of head sites 50 are canted on the wafer so that corners of the rows and columns are placed intermediate the breaks in the segments A–H. It should be noted with this arrangement that electrical potentials to the segments A, B and C may be increased to counterbalance the thieving effect of test site 400. Further, since the head sites at the corners of the rows and columns are closer to thief segments A, C, E and G, segments B, D, F and H may be increased in potential to counterbalance the stronger thieving effect of segments A, C, E and G with the potential on segment F being slightly less than segments B, D and H because of the test site 400. This arrangement further differs from the prior art thief 60 and cathode 42 in FIG. 1 in that when the cathode 42 rotates in FIGS. 2, 4 and 6 the segmented thief 500 rotates therewith.

Clearly, other embodiments and modifications of this invention will occur readily to those of ordinary skill in the art in view of these teachings. Therefore, this invention is to be limited only by the following claims, which include all such embodiments and modifications when viewed in conjunction with the above specification and accompanying drawings.

We claim:

1. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a platin solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the plating solution distributor including:

a hollow central hub centered about said vertical axis and connected to the conduit and the pump for receiving the plating solution;

a plurality of hollow arms connected to the central hub and radially extending therefrom, the hollow arms in fluid communication with the central hub for receiving the plating solution therefrom;

each hollow arm having a plurality of top located openings for facing the plating surface of the workpiece; and the openings in each arm increasing in size from the hub to a terminal end of the arm so that each arm discharges an increasing volume of plating solution from the hub to said terminal end.

2. A plating apparatus as claimed in claim 1 wherein said motor rotates the arms.

3. A plating apparatus as claimed in claim 2 including:

means for retaining the cathode and workpiece in a fixed relationship relative to the plating cup.

4. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the conduit having an outlet for discharging the plating solution into a region between the anobe and the plating solution disteibutor; said plating solution distributor including:

a flat circular plate centered about said vertical axis, the plate having a plurality of apertures for transferring plating solution from said region to the cathode and plating surface of the workpiece; and each aperture increasing in size along a radial from said vertical axis to a periphery of the plate.

5. A plating apparatus as claimed in claim 4 wherein said motor rotates the plate about the vertical axis.

6. A plating apparatus as claimed in claim 5 including:

means for retaining the cathode and workpiece in a fixed relationship relative to the plating cup.

7. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing including receiving the plating solution in a plurality of arms between the anode and the plating surface and said discharging including discharging the plating solution toward the plating surface from openings in the arms which increase in size with a corresponding increase in distance of the openings from the vertical axis; and relatively rotating the cathode and the arms with respect to one another.

8. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing including receiving the plating solution in a plurality of arms between the anode and the plating surface and said discharging including discharging the plating solution toward the plating surface from openings in the arms which increase in size with a corresponding increase in distance of the openings from the vertical axis; and rotating the arms about the vertical axis.

9. A method as claimed in claim 8 further including:

rotating the cathode and plating surface about the vertical axis in a direction opposite to a direction of rotation of the arms.

10. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing including receiving the plating solution in a plurality of arms between the anode and the plating surface and said discharging including discharging the plating solution toward the plating surface from openings in the arms which increase in size with a corresponding increase in distance of the openings from the vertical axis; and holding the cathode and plating surface stationary while the anns rotate about the vertical axis.

11. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing and discharging including passing the plating solution through radially extending apertures in a flat plate between the anode and the plating surface, each aperture increasing in size with a corresponding increase in distance from the vertical axis; and relatively rotating the cathode and the flat plate with respect to one another.

12. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing and discharging including passing the plating solution through radially extending apertures in a flat plate between the anode and the plating surface, each aperture increasing in size with a corresponding increase in distance from the vertical axis; and rotating the flat plate about the vertical axis.

13. A method as claimed in claim 12 further including:

rotating the cathode about the vertical axis in a direction opposite to a direction of rotation of the flat plate.

14. A method of plating a workpiece that has a flat plating surface in a plating apparatus, the plating apparatus including a circular plating cup located in a plating bowl, the plating cup having a top located circular rim centered on a vertical axis, the plating cup and plating bowl containing a plating solution, an anode fixed in a bottom portion of the plating cup and a cathode located in a top portion of the plating cup, the cathode mounting the workpiece with the plating surface facing downwardly in the plating solution, a conduit and pump for recirculating the plating solution by circulating the plating solution from the plating bowl to the plating cup, then upwardly in the plating cup to the plating surface and over the rim of the plating cup back into the plating bowl, the method comprising:

during circulation of the plating solution between the anode and the plating surface, capturing the plating solution and discharging the plating solution toward the plating surface with an increase in volume that corresponds to an increase in distance from the vertical axis;

said capturing and discharging including passing the plating solution through radially extending apertures in a flat plate between the anode and the plating surface, each aperture increasing in size with a corresponding increase in distance from the vertical axis; and holding the cathode stationary while rotating the flat plate about the vertical axis.

15. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

an annular thief centered about the vertical axis and divided into discrete spaced apart thief segments that are located about the cathode; and a source connected to each thief segment for applying differential currents to the thief segments.

16. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the plating solution distributor including:

a hollow central hub centered about said vertical axis and connected to the conduit and the pump for receiving the plating solution;

a plurality of hollow arms connected to the central hub and radially extending therefrom, the hollow arms in fluid communication with the central hub for receiving the plating solution therefrom;

each hollow arm having a plurality of top located openings for facing the plating surface of the workpiece; and the openings in each arm increasing in size from the hub to a terminal end of the arm so that each arm discharges an increasing volume of plating solution from the hub to said terminal end;

an annular thief centered about the vertical axis and divided into discrete spaced apart thief segments that are located about the cathode; and a source connected to each thief segment for applying differential potentials to the thief segments.

17. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the plating solution distributor including:

a hollow central hub centered about said vertical axis and connected to the conduit and the pump for receiving the plating solution;

a plurality of hollow arms connected to the central hub and radially extending therefrom, the hollow arms in fluid communication with the central hub for receiving the plating solution therefrom;

each hollow arm having a plurality of top located openings for facing the plating surface of the workpiece; and the openings in each arm increasing in size from the hub to a terminal end of the arm so that each arm discharges an increasing volume of plating solution from the hub to said terminal end;

said motor for rotating the arms;

means for retaining the cathode and workpiece in a fixed relationship relative to the plating cup;

an annular thief centered about the vertical axis and divided into discrete spaced apart thief segments that are located about the cathode; and a source connected to each thief segment for applying differential potentials to the thief segments.

18. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the conduit having an outlet for discharging the plating solution into a region between the anode and the plating solution distributor;

said plating solution distributor including:

a flat circular plate centered about said vertical axis, the plate having a plurality of apertures for transferring plating solution from said region to the cathode and plating surface of the workpiece; and each aperture increasing in size along a radial from said vertical axis to a periphery of the plate;

an annular thief centered about the vertical axis and divided into discrete spaced apart thief segments that are located about the cathode; and a source connected to each thief segment for applying differential potentials to the thief segments.

19. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the conduit having an outlet for discharging the plating solution into a region between the anode and the plating solution distributor;

said plating solution distributor including:

a flat circular plate centered about said vertical axis, the plate having a plurality of apertures for transferring plating solution from said region to the cathode and plating surface of the workpiece;

each aperture increasing in size along a radial from said vertical axis to a periphery of the plate;

said motor for rotating the plate about the vertical axis;

means for retaining the cathode and workpiece in a fixed relationship relative to the plating cup;

an annular thief centered about the vertical axis and divided into discrete spaced apart thief segments that are located about the cathode; and a source connected to each thief segment for applying differential potentials to the thief segments.

20. A plating apparatus comprising:

a plating bowl for providing a first portion of a plating solution;

a circular plating cup located in the plating bowl for providing a second portion of the plating solution, the plating cup having top and bottom portions and a top circular rim that is centered about a vertical axis;

a conduit and a pump interconnecting the plating bowl to a bottom portion of the plating cup to recirculate the plating solution by transfer from the plating bowl to the bottom portion of the plating cup, then upwardly in the plating cup and over the circular rim back into the plating bowl;

an anode located within the bottom portion of the plating cup and a cathode located adjacent the top portion of the plating cup, the cathode being capable of supporting a workpiece with a plating surface of the workpiece facing downwardly to receive an upward flow of the plating solution;

a plating solution distributor located in the plating cup between the anode and the cathode in a spaced relationship therebetween and centered about said vertical axis;

a motor for relatively rotating the cathode and the plating solution distributor with respect to one another;

the plating solution distributor for distributing the plating solution over said plating surface of the workpiece at a volume that increases radially away from said vertical axis;

the conduit having an outlet for discharging the plating solution into a region between the anode and the plating solution distributor;

said plating solution distributor including:

a flat circular plate centered about said vertical axis, the plate having a plurality of apertures for transferring plating solution from said region to the cathode and plating surface of the workpiece; and each aperture increasing in size along a radial from said vertical axis to a periphery of the plate;

the plate having a periphery which is fixed to an inside surface of the plating cup and is sealed thereto;

said motor for rotating the cathode and the workpiece;

an annular thief centered about the vertical axis and divided into discrete spaced apart thief segments that are located about the cathode; and a source connected to each thief segment for applying differential potentials to the thief segments.

* * * * *